US005724019A

United States Patent [19]

Pearson

[11] Patent Number: 5,724,019

[45] Date of Patent: Mar. 3, 1998

[54] FLEXIBLE POTENTIOMETER

[75] Inventor: Earl C. Pearson, Knoxville, Tenn.

[73] Assignee: Robertshaw Controls Company, Richmond, Va.

[21] Appl. No.: 669,795

[22] Filed: Jun. 27, 1996

[51] Int. Cl.[6] ..... H01C 3/06

[52] U.S. Cl. ..... 338/210

[58] Field of Search ..... 338/210, 211, 338/212, 214

[56] References Cited

U.S. PATENT DOCUMENTS

| | | | |
|---|---|---|---|
| 528,893 | 11/1894 | Shaw | 338/210 |
| 3,974,471 | 8/1976 | Gilliland | 338/202 |
| 4,081,782 | 3/1978 | Hildreth et al. | 338/200 |
| 4,114,134 | 9/1978 | Kley | 338/231 |
| 4,401,968 | 8/1983 | Shellenberger | 338/176 |
| 4,651,123 | 3/1987 | Zepp | 338/176 |
| 5,157,372 | 10/1992 | Langford | 338/211 |
| 5,494,255 | 2/1996 | Pearson et al. | 251/129.15 |
| 5,606,303 | 2/1997 | Suski | 338/210 |

*Primary Examiner*—Matthew V. Nguyen
*Attorney, Agent, or Firm*—Watts, Hoffmann, Fisher & Heinke Co., LPA

[57] ABSTRACT

A potentiometer for generating an electrical signal. The potentiometer has an elongated carrier formed of a flexible material and a band of resistive material applied to the carrier. A conductive wiper element is coupled to the elongated carrier at a position remote from the band of resistive material so that when the carrier is bent an electric contact is formed between the resistive band and the wiper element. An electrical signal is generated from the wiper element as flexing of the carrier occurs due to movement of a potentiometer actuator. Both a linear potentiometer and a rotary potentiometer are disclosed.

26 Claims, 3 Drawing Sheets

FLEXIBLE POTENTIOMETER

FIELD OF THE INVENTION

The present invention concerns a potentiometer for use in generating an electrical signal based upon the position of a mechanical actuator.

BACKGROUND ART

Electrical potentiometers are devices that output an electrical signal based on the position or orientation of a potentiometer actuator. In one typical configuration the potentiometer has a conductive strip that is energized at one end and grounded at an opposite end. A movable conductive contact is attached to an actuator and moves along the extent of the conductive strip as the actuator moves. This conductive contact taps off the electrical potential applied to the strip to provide an electrical signal related to the position of the actuator. One example of such an actuator controlled potentiometer is disclosed in issued U.S. Pat. No. 5,494,255 to Frankenburg et al. The disclosure of the '255 Frankenbrug et al. patent is incorporated herein by reference.

Other forms of potentiometers are known. Another well-known design of potentiometer has a curved conductive strip and a rotatably mounted contact connected to an actuator that is rotated to adjust the output from the potentiometer. Instead of monitoring the position of the actuator this type of potentiometer is used to produce an electrical output signal of a controlled size by adjusting the orientation of the actuator.

U.S. Pat. No. 5,157,372 to Langford concerns a so-called "Flexible Potentiometer" that is made using a flexible substrate having a conductive ink pattern applied to the substrate. The '372 patent states that the resistance of the ink consistently and predictably changes upon deflection or bending of the substrate. Application of an electric signal to the conductive pattern produces a controlled output signal from the pattern due to the change in resistance as the substrate is deflected.

DISCLOSURE OF THE INVENTION

The present invention concerns a potentiometer that includes a resistive pattern supported on an elongated flexible substrate that produces an electrical signal related to the flexing of the elongated flexible substrate. A conductive element is also coupled to the substrate and defines a wiper element for the potentiometer for providing the electric signal.

In accordance with a preferred embodiment of the invention, relative movement between the conductive or wiper element and the resistive pattern brings the conductive element into sliding engagement with the resistive pattern. The electrical signal output from the potentiometer is generated when a portion of the substrate between the conductive element and the resistive pattern flexes. Due to this flexure the wiper element moves along a surface of the resistive strip and an output signal is coupled away from the wiper element to an external circuit. Both a linear and a rotary version of a potentiometer constructed in accordance with the invention are disclosed.

Another aspect of the present invention relates to a method for sensing a position of a mechanical component by providing a flexible carrier for an electrical component and a conductive wiper and coupling the electrical component and the conductive wiper to a position indicating circuit. The mechanical component is connected to the carrier so that the carrier flexes as the mechanical component moves to effect relative movement between the conductive wiper and the electrical component. The position of the mechanical component is sensed based on a position of the conductive wiper relative to the electrical component.

Other aspects of the invention concern a method of manufacture of a potentiometer constructed in accordance with the embodiments disclosed in this application. These and other aspects, advantages and features of the invention are disclosed and described in conjunction with the accompanying drawing.

The flexible potentiometer articulates rotary or linear motion to an electrical output with out a separate slide circuit or commutator circuit, common to all other potentiometers. The slide circuit or track in all other sensors allows the signal derived by the rotating or linear motion to be translated to a "stationary" commutator circuit. This requires the use of two wipers, one on the film circuit and one on the slide circuit. This sensor does not require this commutator track and associated wiper, as only one wiper is mounted directly to the circuit. The flex circuit acts as the "stationary" slide circuit carrying the signal to the stationary terminal pin. This reduces the electrical circuit and associated connections by 50% allowing twice the reliability with 50% fewer parts.

DETAILED DESCRIPTION OF DISCLOSED EMBODIMENTS

Figures 1, 2:
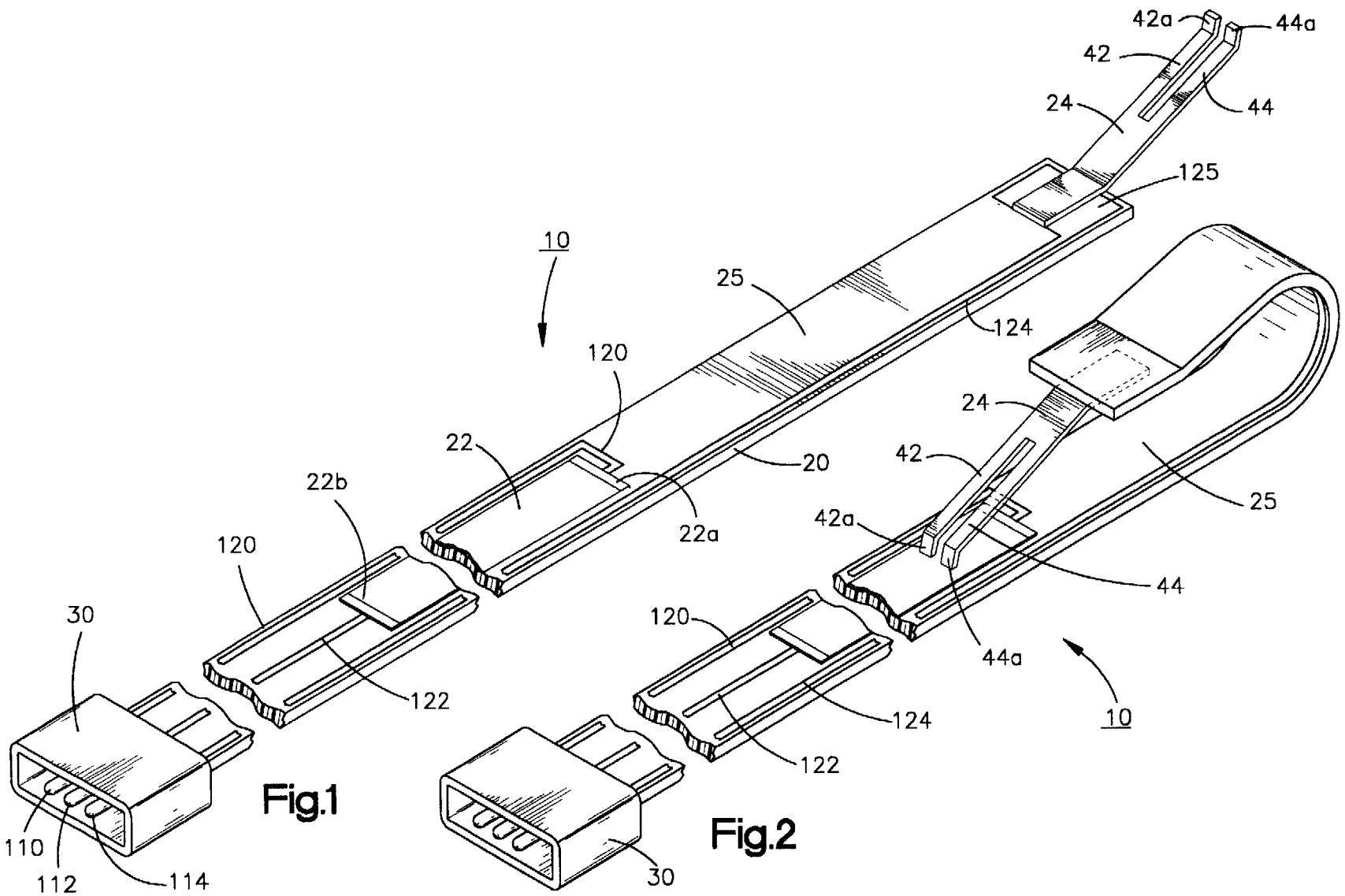
FIG. 1 is a perspective view of one embodiment of a potentiometer constructed in accordance with the present invention wherein a flexible substrate is unflexed.
FIG. 2 is a perspective view of the FIG. 1 embodiment with the substrate flexed.
Figure 3:
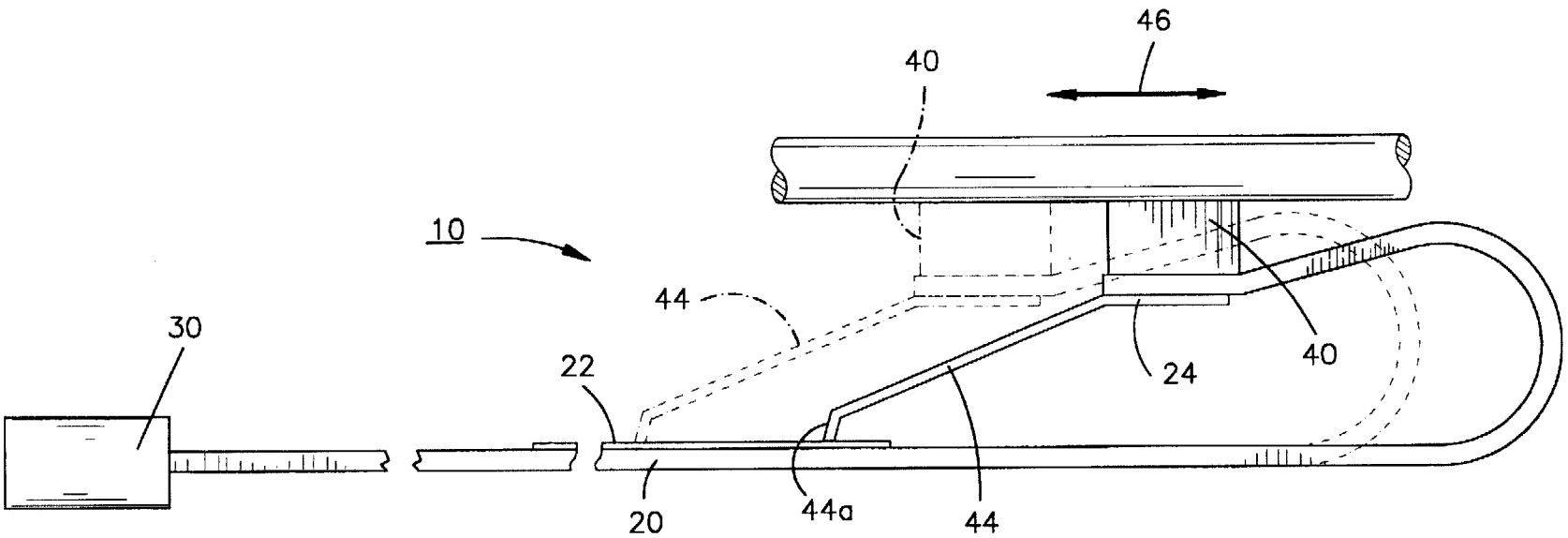
FIG. 3 is an elevation view of the FIG. 2 embodiment of the invention showing a mechanical actuator attached to the substrate.

FIG. 1 illustrates a first embodiment of the present invention. The FIG. 1 illustration depicts a potentiometer 10 that produces an electrical signal that changes in response to movement of an actuator 12 (FIG. 3). The potentiometer includes a carrier member 20 formed of a flexible material that is preferably an electrically insulating material. An electrically conductive component, typically in the form of an elongated controlled resistivity band 22, is formed on the carrier member 20. A conductive element that forms a conductive contact 24 is also coupled to the carrier member 20 at a position spaced from the electrical component 22 by an insulating portion 25 of the carrier member 20.

In accordance with this embodiment of the invention, the carrier member 20 is bent (FIG. 2) to bring the conductive contact 24 into electrical engagement with the conductive strip 22. An electrical signal output from a potentiometer connector 30 changes as a portion of the carrier member 20 between the conductive contact element 24 and the electrically conductive strip 22 flexes due to back and forth movement of the actuator 12 which is attached to the carrier 20 by a coupling 40 connected to both the carrier 20 and to the actuator 12.

In accordance with the FIG. 1 embodiment of the invention the contact 24 is a wiper member having two spaced apart flexible conductive legs 42, 44 having bent ends 42a, 44a that engage a generally planar surface of the band or strip 22. As seen in the elevation view of FIG. 3 the carrier 20 is biased to a flexed shape and maintained in that shape by the actuator pressing down through the coupling 40 against the carrier 20. As the actuator moves back and forth, it follows a path of travel as indicated by the double headed arrow 46 in FIG. 3. At all points along the path of travel, the ends 42a, 44a of the wiper legs 42, 44 remain in contact with the conductive band 22.

The perspective views of FIGS. 1 and 2 illustrate the manner in which an electrical signal is produced from the potentiometer 10. At one end of the carrier 22 the potentiometer connector 30 is seen to include connector pins 110, 112, 114 that mate with an appropriate female electrical connector (not shown). A first pin 110 is in electrical engagement with a conductor 120 that extends along a length of the carrier 20 to one end 22a of the band 22 where the conductor 120 is attached to the end of the band 22. A second pin 112 is in electrical engagement with a conductor 122 that extends a relatively short distance along the carrier 20 to an opposite end 22b of the band 22. At third pin 114 is in electrical engagement with a third conductor 124 that extends the entire length of the carrier 20 and is in electrical engagement with a conductive land 125 that supports the contact 24.

As the carrier or substrate 20 is flexed due to movement of the actuator, the wiper legs 42, 44 move along the surface of the resistive band or strip 22 and an output signal at the pin 114 is coupled away from the potentiometer 10 to an external circuit. One of the two pins 110, 112 is grounded or maintained at a reference potentional and a second of the two pins 110, 112 is energized at a potential to maintain a potential difference across the two pins 110, 112. When the wiper legs 42, 44 contact the band 22 close to the end 20a to which the conductor 120 extends, a relatively large potential drop exists from the legs 42, 44 to the pin 112 attached to the conductor 122. As the actuator moves to the left in FIG. 3, the wiper legs 42, 44 slide along the surface of the band 22 and the electric potential of the legs approaches the potential at the pin 112. In accordance with the preferred embodiment of the present invention the change in output voltage is directly proportional to the displacement of the actuator. By suitable adjustment to the resistivity or the width of the band 22, however, the response could be made non-linear.

Figure 4:
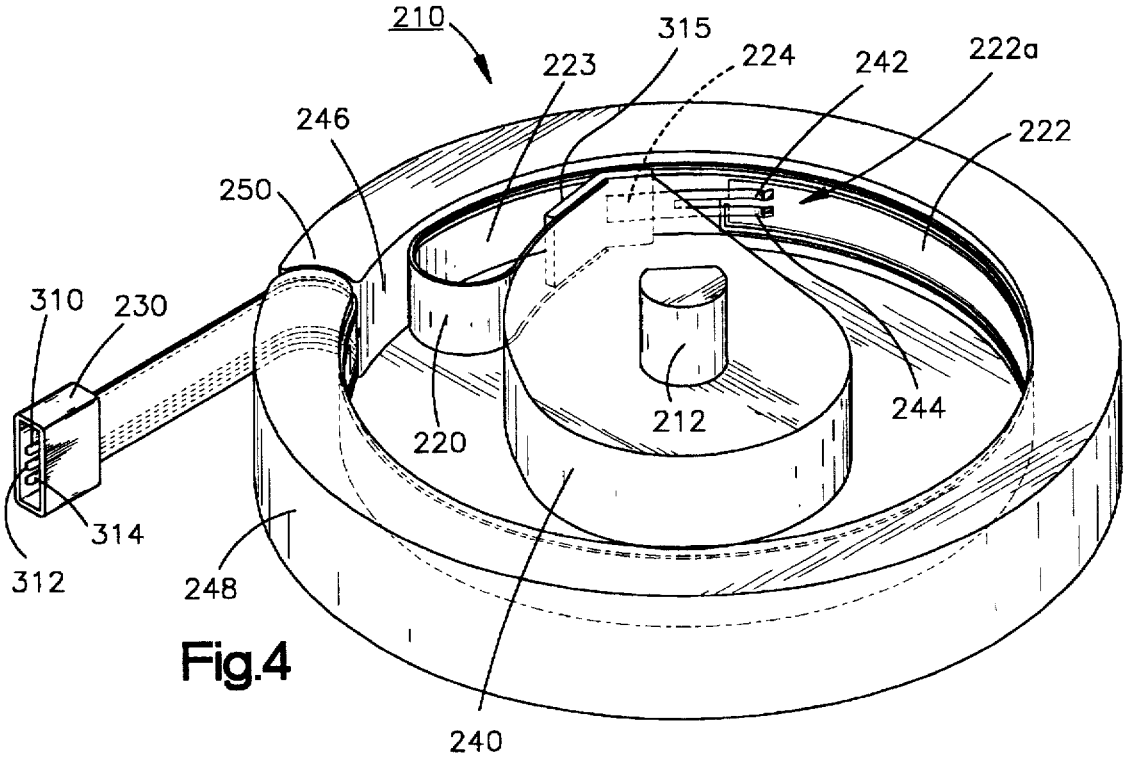
FIG. 4 is a perspective view of a second embodiment of a potentiometer constructed in accordance with the invention.
Figure 5:
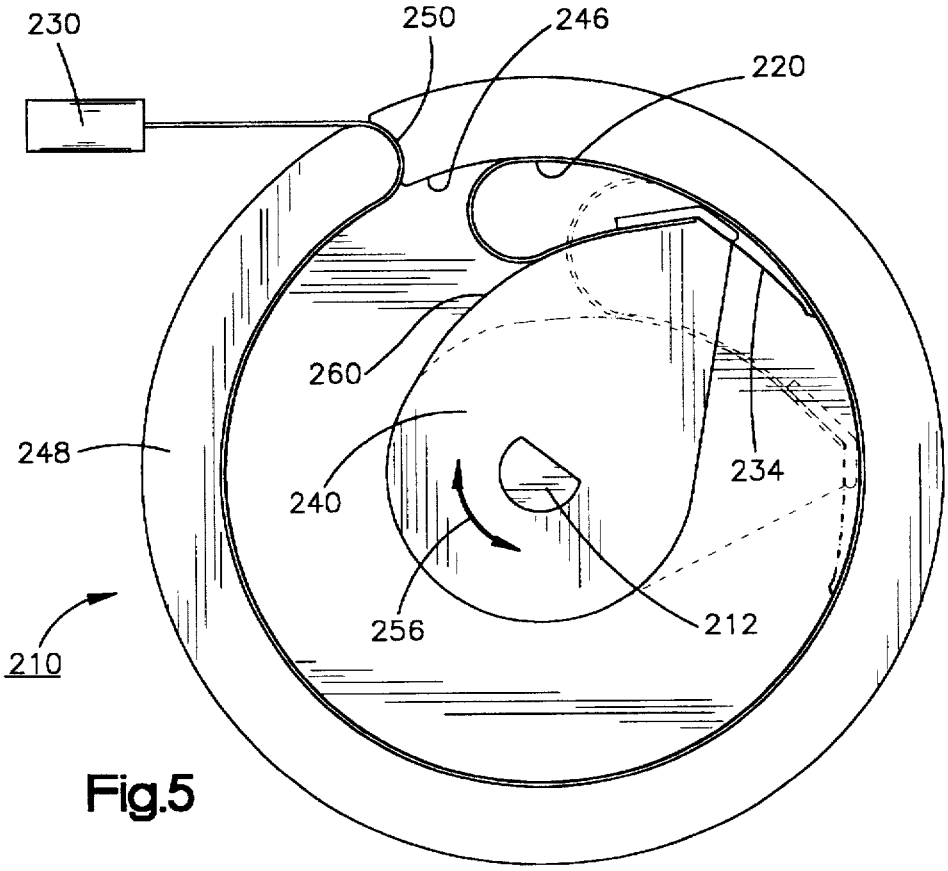
FIG. 5 is a plan view of the FIG. 4 embodiment of the invention.

FIGS. 4 and 5 illustrate a second embodiment of the present invention. These figures depict a potentiometer 210 that produces an electrical signal that changes in response to movement of an actuator 212. The potentiometer includes a carrier member 220 formed of a flexible material that is preferably an electrically insulating material. An electrically conductive component typically in the form of an elongated band 222 is formed on the carrier member 220. A conductive element that forms a conductive contact 224 is also coupled to the carrier member 220 at a position spaced from the electrical component 222 by an insulating portion 223 of the carrier member 220.

In accordance with the second embodiment of the invention, the carrier member 220 is bent at one end to form a loop that brings the conductive contact 224 into electrical engagement with the conductive strip 222. An electrical signal output from a potentiometer connector 230 changes as the electrically conductive strip 222 flexes due to movement of the actuator 212 that is attached to the carrier 220 by a reel 240 which rotates with the actuator.

Like the FIG. 1 embodiment of the invention, the contact 224 is a wiper member having two spaced apart legs 242, 244 that engage a generally curved surface of the band or strip 222. As seen in FIGS. 3 and 4 the carrier member 220 is supported on a curved, generally cylindrical inside surface 246 of a potentiometer base 248 that rotatably supports the reel 240. The base 248 has a gap 250 through which the carrier 220 extends so that the electrical connector 230 is positioned outside the region bounded by the bases inwardly facing surface 246.

As the actuator 212 rotates back and forth through different orientations, it causes the reel 240 to rotate back and forth as indicated by the double headed arrow 256 in FIG. 5. As the reel rotates it moves the contact 224 in an arcuate path with the wiper legs 242, 244 in contact with the conductive band 222.

The second embodiment shown in FIGS. 4 and 5 generates signals in a manner similar to the first embodiment shown in FIGS. 1–3. At the end of the carrier 220 that extends through the gap 250 and outside the base 248, the electrical connector 230 has connector pins 310, 312, 314 that mate with an appropriate female electrical connector (not shown). A first pin 310 is in electrical engagement with a conductor (not shown) that extends along a length of the carrier 220 and electrically connected to one end 222a of the band 222. A second pin 312 is in electrical engagement with a conductor (not shown) that extends a relatively short distance along the carrier 20 to an opposite end of the band 222. A third pin 314 is connected to a conductor (not shown) that extends the entire length of the carrier 220 from the connector 230 to a metal support 315 the contact 224.

A fixed potential is maintained between the two pins 310, 312 so that a fixed potential is maintained across the length of the band 222. As the actuator rotates the wiper legs move with the reel and slide across the surface of the band 222. The phantom view of the reel in FIG. 5 illustrates an orientation of the reel rotated from its extreme counterclockwise orientation. In the extreme counterclockwise orientation the wiper legs are located near one end 222a of the conductive band 222 and therefore the output signal on the connector pin coupled to the legs yields a voltage close to the voltage at the pin 310. In the phantom orientation of FIG. 5 the legs 242, 244 have been rotated around the surface of the conductive band 222 so that the signal output on the pin 314 connected to the legs is different from the output at pin 310 by an amount related to the angular displacement of the reel. In a preferred embodiment the voltage changes in direct proportion to the angular rotation of the reel, but in other embodiments the output could be changed to produce a different relation between the amount of rotation and the signal output from the potentiometer 210.

As the reel is rotated by the actuator, the carrier 220 separates from the inner surface 246 of the base. As the reel rotates a portion of the carrier nearest the legs contacts an outer surface 260 of the reel and wraps around the reel as rotation continues.

The elongated carrier members 20, 220 are most preferably constructed from elongated plastic strips sold under the designation Kapton™. Kapton™ is a polyimide film commercially available from the industrial Films Division of DuPont Corporation. This polyimide film maintains its physical, electrical and mechanical properties over a wide temperature range. It is synthesized by a polycondensation reaction between an aromatic dianhydride and an aromatic diamine. The bands 22, 222 are most preferably applied to the carrier members in the form of a resistive ink. The various conductors that are supported by the carrier members and coupled to the connector pins are preferably printed silver conductors that are applied by a screening process well known in the prior art. This process creates the conductive land 125 and the contact 24 is crimped or soldered to the land 125. In the preferred construction contact 24 is constructed from a gold and beryllium alloy stamped and bent to form its wiper legs.

It is appreciated that while two detailed embodiments of the invention have been described with a degree of particularity, it is the intent that the invention include all modifications and alterations from those two embodiments falling within the spirit or scope of the appended claims.

I claim:

1. A method for generating an electrical signal comprising the steps of:

a) providing a flexible elongated carrier for an electrical component and a conductive element;

b) coupling the electrical component and the conductive element to circuitry;

c) effecting relative movement between the conductive element and the electrical component to flex at least a portion of the elongated carrier; and d) forming an electrical contact between the conductive element and the electrical component to generate the electrical signal that varies as the elongated carrier flexes.

2. The method of claim 1, wherein the conductive element is a wiper and wherein the electrical signal is generated based on a position of the wiper relative to the electrical component.

3. The method of claim 1, wherein the conductive element is coupled at one end of the elongated carrier.

4. The method of claim 1, wherein the elongated carrier is formed of Kapton™.

5. The method of claim 1, wherein the conductive element is formed of beryllium and copper.

6. The method of claim 1, wherein the electrical component is a resistive pad.

7. The method of claim 6, wherein the resistive pad includes resistive ink.

8. A method for sensing a position of a mechanical component, comprising the steps of:

a) providing a flexible, elongated carrier for an electrical component and a conductive wiper;

b) coupling the electrical component and the conductive wiper to position indication circuitry;

c) coupling the mechanical component to the elongated carrier;

d) flexing at least a portion of the elongated carrier;

e) moving the mechanical component to effect relative movement between the conductive wiper and the electrical component;

f) altering the flexure of the elongated carrier in response to the moving step (e); and g) sensing the position of the mechanical component based on a position of the conductive wiper relative to the electrical component.

9. The method of claim 8, wherein the conductive wiper is coupled to one surface of the elongated carrier at one end of the elongated carrier and wherein the mechanical component is coupled to an opposing surface of the elongated carrier at the one end of the elongated carrier.

10. The method of claim 8, wherein the moving step (e) includes the step of reciprocating the mechanical component along a linear path.

11. The method of claim 8, wherein the moving step (e) includes the step of rotating the mechanical component about an axis.

12. The method of claim 8, wherein the elongated carrier is formed of Kapton™.

13. The method of claim 8, wherein the conductive wiper is formed of beryllium and copper.

14. The method of claim 8, wherein the electrical component is a resistive pad.

15. The method of claim 8, wherein the resistive pad includes resistive ink.

16. A method for fabricating a sensor, the method comprising the steps of:

a) forming an elongated carrier from a flexible material;

b) forming a resistive pad on a first surface of the elongated carrier;

c) forming a pair of pad conductors on the elongated carrier such that the pair of pad conductors are electrically coupled to opposing ends of the resistive pad;

d) coupling a conductive wiper to the elongated carrier such that the conductive wiper is positioned on the elongated carrier separate from the resistive pad; and e) forming a wiper conductor on the elongated carrier such that the wiper conductor is electrically coupled to the conductive wiper.

17. The method of claim 16, wherein the conductive element is coupled at one end of the elongated carrier.

18. The method of claim 16, wherein the elongated carrier is formed of Kapton™.

19. The method of claim 16, wherein the conductive wiper is formed of beryllium and copper.

20. The method of claim 16, wherein the resistive pad includes resistive ink.

21. An apparatus for generating an electrical signal, the apparatus comprising:

a) a elongated carrier formed of a flexible material;

b) an electrical component formed on the elongated carrier; and c) a conductive element coupled to the elongated carrier at a position remote from the electrical component such that relative movement may be effected between the conductive element and the electrical component to form an electrical contact between the conductive element and the electrical component and generate the electrical signal and such that at least a portion of the elongated carrier between the conductive element and the electrical component flexes in response to the effected relative movement.

22. The apparatus of claim 21, wherein the conductive element is coupled at one end of the elongated carrier.

23. The apparatus of claim 21, wherein the conductive element is a wiper for conducting the electrical signal based on a position of the wiper relative to the resistive pad.

24. The apparatus of claim 21, wherein the elongated carrier is formed of Kapton™.

25. The apparatus of claim 21, wherein the conductive element is formed of beryllium and copper.

26. The apparatus of claim 21, wherein the resistive pad includes resistive ink.

* * * * *